US009460661B2

(12) United States Patent
Shim et al.

(10) Patent No.: US 9,460,661 B2
(45) Date of Patent: Oct. 4, 2016

(54) ORGANIC LIGHT EMITTING DISPLAY AND METHOD OF COMPENSATING FOR MOBILITY THEREOF

(71) Applicant: LG Display Co., Ltd., Seoul (KR)

(72) Inventors: Jongsik Shim, Goyang-si (KR); Hongjae Shin, Seoul (KR); Nayoung Bae, Busan (KR)

(73) Assignee: LG DISPLAY CO., LTD., Seoul (KR)

( * ) Notice: Subject to any disclaimer, the term of this patent is extended or adjusted under 35 U.S.C. 154(b) by 41 days.

(21) Appl. No.: 14/535,078

(22) Filed: Nov. 6, 2014

(65) Prior Publication Data

US 2015/0123953 A1 May 7, 2015

(30) Foreign Application Priority Data

Nov. 6, 2013 (KR) ..... 10-2013-0134256

(51) Int. Cl.
*G09G 3/32* (2016.01)

(52) U.S. Cl.
CPC .... *G09G 3/3233* (2013.01); *G09G 2300/0819* (2013.01); *G09G 2300/0842* (2013.01); *G09G 2320/0233* (2013.01); *G09G 2320/0295* (2013.01)

(58) Field of Classification Search
None
See application file for complete search history.

(56) References Cited

U.S. PATENT DOCUMENTS

2009/0051628 A1* 2/2009 Kwon ..... G09G 3/3233 345/77
2010/0103082 A1* 4/2010 Levey ..... G09G 3/3233 345/76
2010/0188384 A1* 7/2010 Uchino ..... G09G 3/3233 345/211
2013/0050292 A1* 2/2013 Mizukoshi ..... G09G 3/3291 345/690
2013/0083001 A1* 4/2013 Jeong ..... G09G 3/3233 345/212
2013/0147690 A1* 6/2013 Kim ..... G09G 3/3233 345/76
2015/0213757 A1* 7/2015 Takahama ..... G09G 3/3291 345/691

* cited by examiner

*Primary Examiner* — Kathy Wang-Hurst
*Assistant Examiner* — Peijie Shen
(74) *Attorney, Agent, or Firm* — Birch, Stewart, Kolasch & Birch, LLP

(57) ABSTRACT

An organic light emitting display can include a display panel including a plurality of pixels of a source following manner, in which a source voltage of a driving thin film transistor (TFT) is changed according to a current flowing between a drain electrode and a source electrode of the driving TFT, a gate driving circuit for generating a mobility sensing gate pulse for operating the pixel in the source following manner, a data driving circuit for detecting a sensing voltage corresponding to mobility of the driving TFT from the pixel in response to the mobility sensing gate pulse, and a timing controller for setting a mobility sensing period in a period, in which a gate-source voltage of the driving TFT is greater than a threshold voltage of the driving TFT.

12 Claims, 7 Drawing Sheets

ORGANIC LIGHT EMITTING DISPLAY AND METHOD OF COMPENSATING FOR MOBILITY THEREOF

This application claims the benefit of Patent Application No. 10-2013-0134256 filed on Nov. 6, 2013 in the Republic of Korea, which is incorporated herein by reference for all purposes as if fully set forth herein.

BACKGROUND OF THE INVENTION

1. Field of the Invention

Embodiments of the invention relate to an active matrix organic light emitting display, and more particularly to an organic light emitting display and a method of compensating for mobility thereof.

2. Discussion of the Related Art

An active matrix organic light emitting display includes organic light emitting diodes (hereinafter, abbreviated to "OLEDs") capable of emitting light by itself and has advantages of a fast response time, a high light emitting efficiency, a high luminance, a wide viewing angle, and the like.

The OLED serving as a self-emitting element includes an anode electrode, a cathode electrode, and an organic compound layer formed between the anode electrode and the cathode electrode. The organic compound layer includes a hole injection layer HIL, a hole transport layer HTL, a light emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the light emitting layer EML and form excitons. As a result, the light emitting layer EML generates visible light.

The organic light emitting display arranges pixels each including the OLED in a matrix form and adjusts a luminance of the pixels depending on a gray scale of video data. Each pixel includes a driving thin film transistor (TFT) for controlling a driving current flowing in the OLED. It is preferable that electrical characteristics (including a threshold voltage, a mobility, etc.) of the driving TFT are equally designed in all of the pixels. However, in practice, the electrical characteristics of the driving TFTs of the pixels are not uniform due to various causes. A deviation between the electrical characteristics of the driving TFTs results in a luminance deviation between the pixels.

Various compensation methods of compensating for the deviation between the electrical characteristics of the driving TFTs are known. The compensation methods are classified into an internal compensation method and an external compensation method. The internal compensation method automatically compensates for a deviation between the threshold voltages of the driving TFTs inside circuits of the pixels. A driving current flowing in the OLED has to be determined irrespective of the threshold voltage of the driving TFT, so as to perform the internal compensation method. Therefore, configuration of the pixel circuit is very complex. Furthermore, the internal compensation method is not suitable to compensate for a deviation between mobilities of the driving TFTs.

The external compensation method measures sensing voltages corresponding to the threshold voltages (or mobilities) of the driving TFTs and modulates video data through an external circuit based on the sensing voltages, thereby compensating for a deviation between the threshold voltages (or mobilities). In the external compensation method, in general, after the deviation between the threshold voltages is compensated, the deviation between the mobilities is compensated. However, in recent, as a resolution of a display panel gradually increases, improving process capability and mass production, etc. are becoming issues. For these reasons, a simpler configuration of the pixel circuit is desired. Hence, the configuration of the pixel circuit applied to the external compensation method needs to be simpler.

SUMMARY OF THE INVENTION

Embodiments of the invention provide an organic light emitting display and a method of compensating for mobility thereof capable of compensating for a deviation between electrical characteristics of driving thin film transistors (TFTs) using an external compensation method with a pixel circuit that has a simpler structure.

Embodiments of the invention also provide an organic light emitting display and a method of compensating for mobility thereof capable of increasing a compensation capability.

In one aspect, there is an organic light emitting display comprising a display panel including a plurality of pixels, each pixel using a source following manner, in which a source voltage of a driving thin film transistor (TFT) is changed according to a current flowing between a drain electrode and a source electrode of the driving TFT, a gate driving circuit is configured to generate a mobility sensing gate pulse for operating the pixel in the source following manner, a data driving circuit is configured to detect a sensing voltage corresponding to a mobility of the driving TFT from the pixel in response to the mobility sensing gate pulse, and a timing controller is configured to set a mobility sensing period for detecting the sensing voltage in a period, in which a gate-source voltage of the driving TFT is greater than a threshold voltage of the driving TFT, wherein the mobility sensing period is included in a period in which the mobility sensing gate pulse is generated at an on-level, wherein the sensing voltage is detected in a predetermined period, which ranges from a start time point of the on-level of the mobility sensing gate pulse to a time point corresponding to 2% of one frame period.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 1 to 9.

Figure 1:
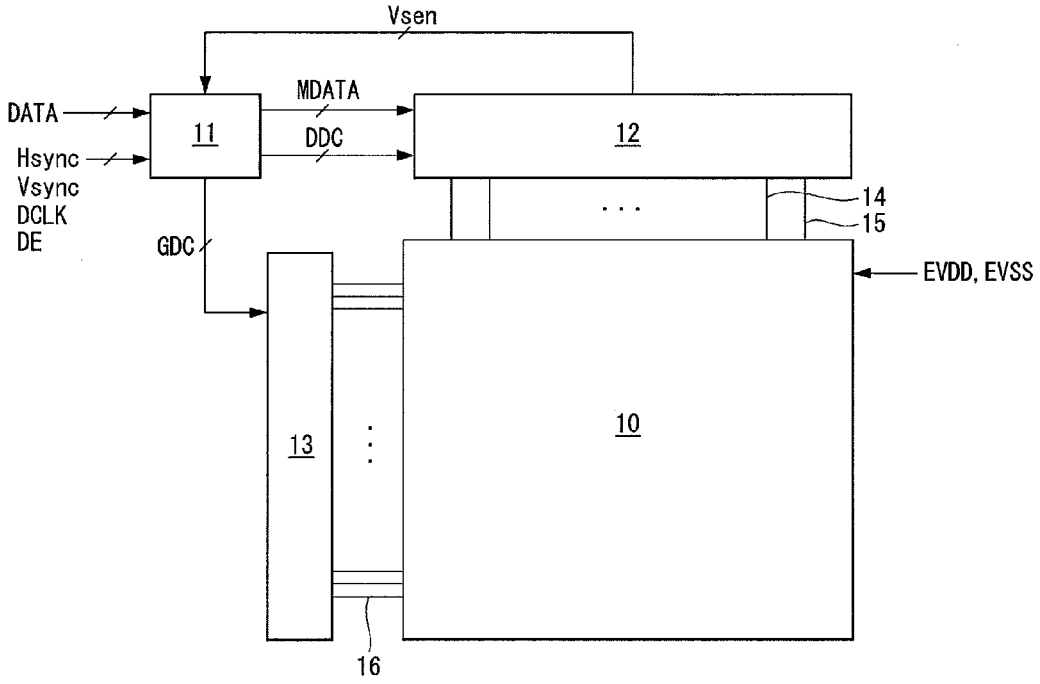
FIG. 1 is a block diagram of an organic light emitting display according to an exemplary embodiment of the invention.
Figure 2:
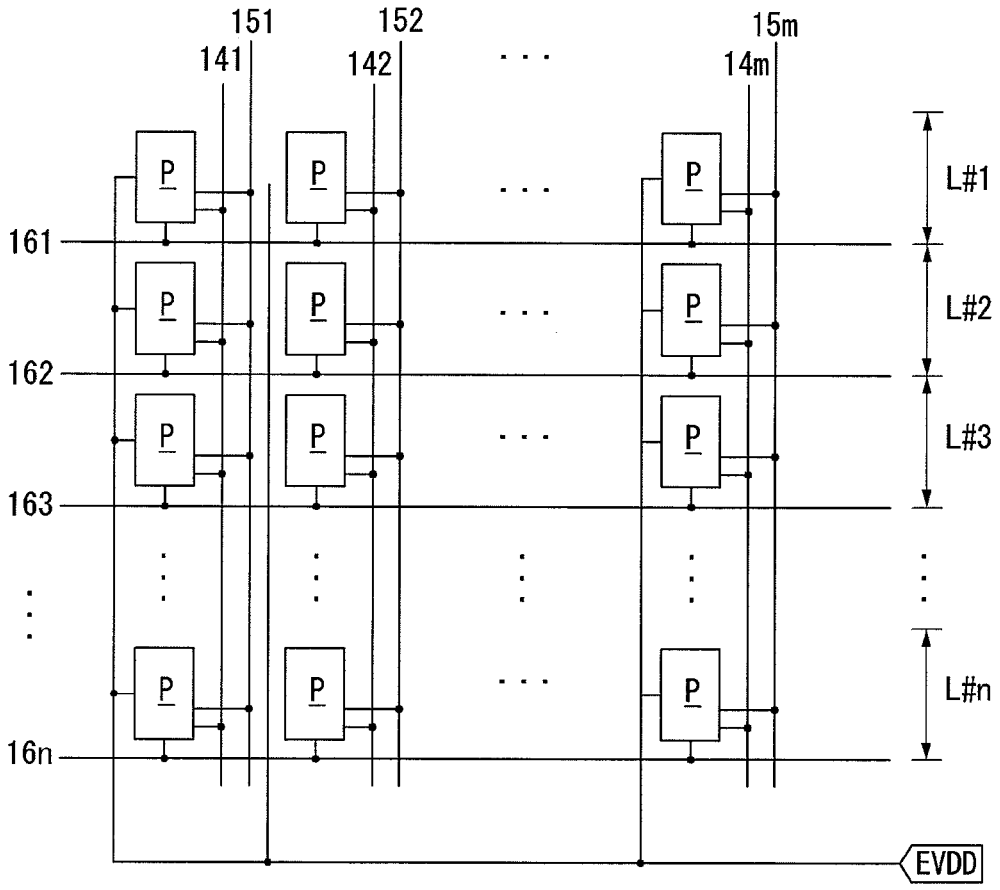
FIG. 2 shows a pixel array of a display panel according to an embodiment of the invention.

FIG. 1 is a block diagram of an organic light emitting display according to an exemplary embodiment of the invention. FIG. 2 shows a pixel array of a display panel.

As shown in FIGS. 1 and 2, the organic light emitting display according to an embodiment of the invention includes a display panel 10, a data driving circuit 12, a gate driving circuit 13, and a timing controller 11.

The display panel 10 includes a plurality of data lines 14 and sensing lines 15, a plurality of gate lines 16 crossing the data lines 14 and the sensing lines 15, and a plurality of pixels P respectively arranged at crossings of the data lines 14, the sensing lines 15, and the gate lines 16 in a matrix form.

Each pixel P is connected to one of data lines 141 to 14*m*, one of sensing lines 151 to 15*m*, and one of gate lines 161 to 16*n*. Each pixel P receives a data voltage through the data line, receives a gate pulse through the gate line, and outputs a sensing voltage through the sensing line. Namely, in a pixel array shown in FIG. 2, the pixels P sequentially operate based on each of horizontal lines L#1 to L#n in response to the gate pulse, which is received from the gate lines 161 to 16*n* in a line sequential manner. The pixels P on the same horizontal line, on which an operation is activated, receive the data voltage from the data lines 141 to 14*m* and output the sensing voltage to the sensing lines 151 to 15*m*.

Each pixel P receives a high potential driving voltage EVDD and a low potential driving voltage EVSS from a power generator (not shown). Each pixel P includes an organic light emitting diode (OLED), a driving thin film transistor (TFT), first and second switch TFTs, and a storage capacitor for the external compensation. Each pixel P is characterized in that the first and second switch TFTs are simultaneously turned on in response to the same gate pulse, so as to reduce the number of signal lines. The TFTs constituting the pixel P may be implemented as a p-type or an n-type. Further, semiconductor layers of the TFTs constituting the pixel P may contain amorphous silicon, polycrystalline silicon, or oxide.

In a sensing drive for sensing electrical characteristics (including a threshold voltage, a mobility, etc.) of the driving TFT, the data driving circuit 12 converts the sensing voltages received from the display panel 10 through the sensing lines 15 into digital values and supplies the digital sensing voltages to the timing controller 11. In an image display drive for the image display, the data driving circuit 12 converts digital compensation data MDATA received from the timing controller 11 into the analog data voltage based on a data control signal DDC and supplies the analog data voltage to the data lines 14.

The gate driving circuit 13 generates the gate pulse based on a gate control signal GDC. The gate pulse includes a threshold voltage sensing gate pulse, a mobility sensing gate pulse, and an image display gate pulse, each of which has a different width. A width of the mobility sensing gate pulse may be much less than a width of the threshold voltage sensing gate pulse. The gate driving circuit 13 may supply the threshold voltage sensing gate pulse to the gate lines 16 in the line sequential manner in the sensing drive of the threshold voltage, and may supply the mobility sensing gate pulse to the gate lines 16 in the line sequential manner in the sensing drive of the mobility. Further, in the image display drive, the gate driving circuit 13 may supply the image display gate pulse to the gate lines 16 in the line sequential manner. The gate driving circuit 13 may be directly formed on the display panel 10 through a gate driver-in panel (GIP) process.

The timing controller 11 generates the data control signal DDC for controlling operation timing of the data driving circuit 12 and the gate control signal GDC for controlling operation timing of the gate driving circuit 13 based on timing signals, such as a vertical sync signal Vsync, a horizontal sync signal Hsync, a data enable signal DE, and a dot clock DCLK. Further, the timing controller 11 modulates input digital video data DATA based on the digital sensing voltage values received from the data driving circuit 12 and generates the digital compensation data MDATA for compensating for a deviation between the electrical characteristics of the driving TFT.

The timing controller 11, according to an embodiment of the invention, sets a mobility sensing period for detecting the sensing voltage in a period, in which a gate-source voltage of the driving TFT is greater than the threshold voltage of the driving TFT, so as to increase a compensation capability of the mobility when sensing the mobility. Further, the timing controller 11 may set the mobility sensing period, so that the sensing voltage is detected in a predetermined period, starting from a time point, at which the mobility sensing gate pulse is generated at an on-level, to a time point corresponding to 2% of one frame period. Namely, when a source voltage of the driving TFT is changed to a gate voltage of the driving TFT through a source following manner shown in FIG. 4 in the sensing drive of the mobility, the timing controller 11 controls the width of the mobility sensing gate pulse and also controls operation timing of an internal switch SW2 (refer to FIG. 3) of the data driving circuit 12, so that the sensing voltage is detected in an initial change period. In other words, the driving TFT is configured as a source follower amplifier (e.g., common-drain amplifier).

The timing controller 11, according to an embodiment of the invention, calculates a gain value through using a compensation function, in which a physical proportional constant K of the driving TFT is applied, and the input digital video data DATA is multiplied by the gain value to generate the digital compensation data MDATA, in which a mobility deviation between the driving TFTs is compensated, so as to further increase the compensation capability of the mobility during sensing of the mobility.

Figure 3:
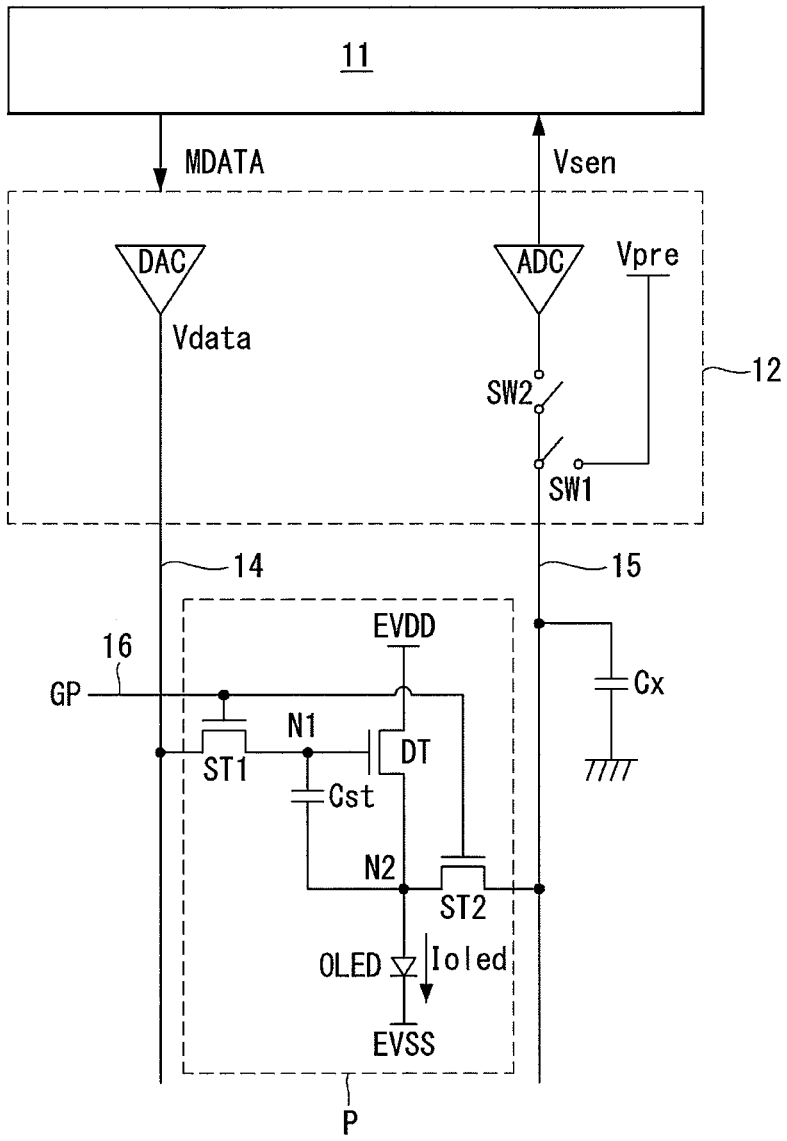
FIG. 3 illustrates a connection structure of a timing controller, a data driving circuit, and pixels along with a detailed configuration of an external compensation pixel according to an embodiment of the invention.
Figure 4:
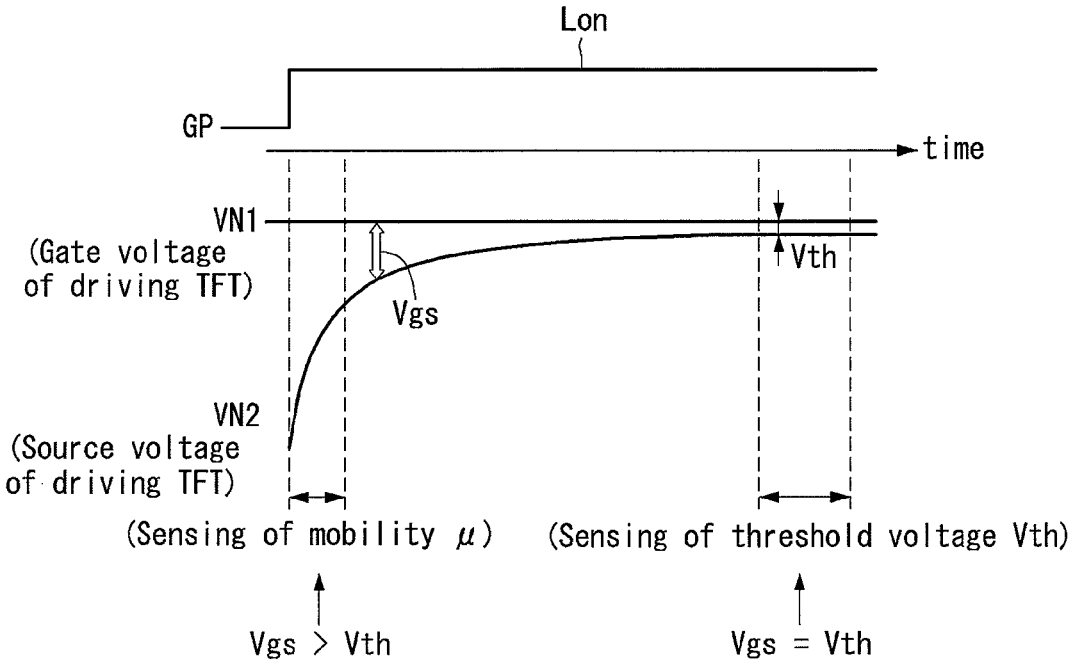
FIG. 4 shows a change in potential for a gate voltage and a source voltage of a driving thin film transistor (TFT) when sensing electrical characteristics of the driving TFT according to an embodiment of the invention.
Figure 5:
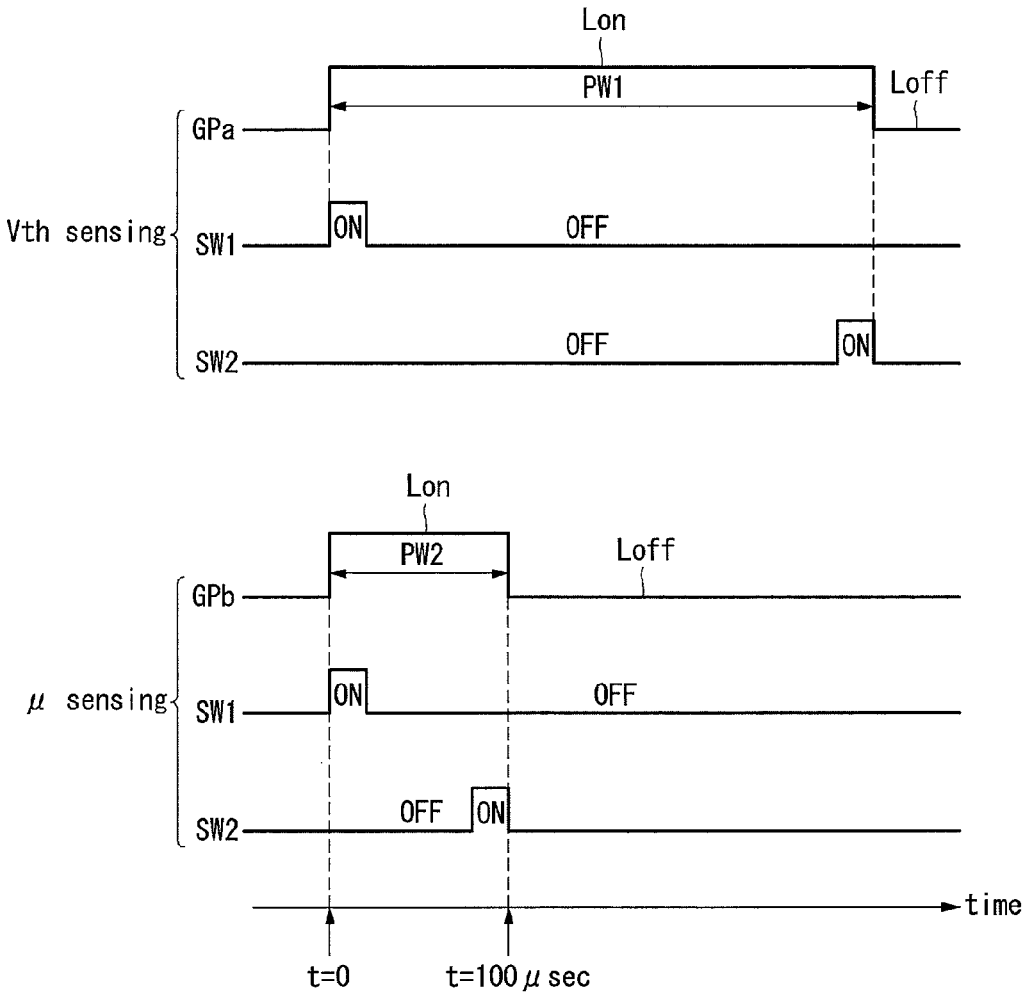
FIG. 5 shows a comparison between a mobility sensing gate pulse, a mobility sensing period, a threshold voltage sensing gate pulse and a threshold voltage sensing period according to an embodiment of the invention.
Figure 6:
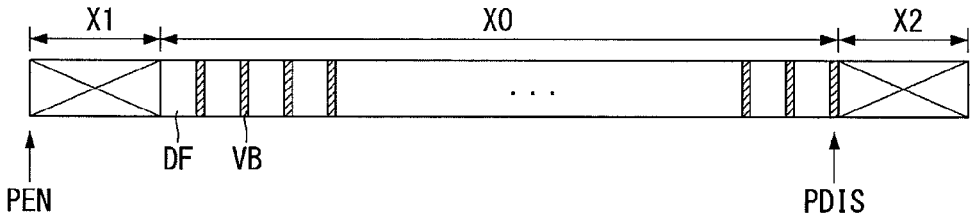
FIG. 6 shows an image display period and non-display periods before and after the image display period according to an embodiment of the invention.

FIG. 3 illustrates a connection structure of the timing controller, the data driving circuit, and the pixels along with a detailed configuration of an external compensation pixel. FIG. 4 shows a change in a potential of each of a gate voltage and a source voltage of the driving TFT in the sensing drive for sensing the electrical characteristics of the driving TFT. FIG. 5 shows a comparison between the mobility sensing gate pulse, a mobility sensing period, the threshold voltage sensing gate pulse and a threshold voltage sensing period. FIG. 6 shows an image display period and non-display periods before and after the image display period.

As shown in FIG. 3, the pixel P may include an OLED, a driving TFT DT, a storage capacitor Cst, a first switch TFT ST1, and a second switch TFT ST2.

The OLED includes an anode electrode connected to a second node N2, a cathode electrode connected to an input terminal of a low potential driving voltage EVSS, and an organic compound layer positioned between the anode electrode and the cathode electrode.

The driving TFT DT controls a driving current Ioled flowing in the OLED depending on a gate-source voltage Vgs of the driving TFT DT. The driving TFT DT includes a gate electrode connected to a first node N1, a drain electrode connected to an input terminal of a high potential driving voltage EVDD, and a source electrode connected to the second node N2.

The storage capacitor Cst is connected between the first node N1 and the second node N2.

The first switch TFT ST1 applies a data voltage Vdata on the data line 14 to the first node N1 in response to a gate pulse GP. The first switch TFT ST1 includes a gate electrode connected to the gate line 16, a drain electrode connected to the data line 14, and a source electrode connected to the first node N1.

The second switch TFT ST2 turns on a current flow between the second node N2 and the sensing line 15 in response to the gate pulse GP. Hence, the second switch TFT ST2 stores a source voltage of the second node N2 in a sensing capacitor Cx on the sensing line 15, which is changed by following a gate voltage of the first node N1 in the source following manner. A gate electrode of the second switch TFT ST2 is commonly connected to the gate electrode of the first switch TFT ST1 and the gate line 16, a drain electrode of the second switch TFT ST2 is connected to the second node N2, and a source electrode of the second switch TFT ST2 is connected to the sensing line 15.

The data driving circuit 12 is connected to the pixel P through the data line 14 and the sensing line 15. The sensing capacitor Cx, which stores the source voltage of the second node N2 as a sensing voltage Vsen, is formed on the sensing line 15. The data driving circuit 12 includes a digital-to-analog converter (DAC), an analog-to-digital converter (ADC), a first switch SW1, and a second switch SW2.

The DAC converts digital data received from the timing controller 11 into the analog data voltage Vdata and outputs the analog data voltage Vdata to the data line 14. The first switch SW1 turns on a current flow between an input terminal of an initialization voltage Vpre and the sensing line 15. The second switch SW2 turns on a current flow between the sensing line 15 and the ADC. The ADC converts the analog sensing voltage Vsen stored in the sensing capacitor Cx into a digital value and supplies the digital sensing voltage Vsen to the timing controller 11.

A process for detecting the sensing voltage Vsen corresponding to a mobility of the driving TFT DT from each pixel P is additionally described below with reference to FIGS. 4 and 5.

The sensing voltage Vsen detected from each pixel P corresponds to mobility μ of the driving TFT DT. The embodiment of the invention applies the data voltage Vdata, in which a threshold voltage Vth of the driving TFT DT is compensated, to each pixel P through the DAC of the data driving circuit 12, before detecting the sensing voltage Vsen.

When a mobility sensing gate pulse GPb of an on-level Lon is applied to the pixel P for sensing the mobility, the first switch TFT ST1 and the second switch TFT ST2 are simultaneously turned on. In this instance, the first switch SW1 inside the data driving circuit 12 is turned on. When the first switch SW1 is turned on, the data voltage Vdata, in which the threshold voltage Vth of the driving TFT DT is compensated, is supplied to the first node N1. When the first switch SW1 and the second switch SW2 are turned on, the initialization voltage Vpre is supplied to the second node N2. In this instance, because the gate-source voltage Vgs of the driving TFT DT is greater than the threshold voltage Vth of the driving TFT DT, the driving current Ioled flows between the drain electrode and the source electrode of the driving TFT DT. A source voltage VN2 of the driving TFT DT charged by the second node N2 gradually increases due to the driving current Ioled. Hence, until the gate-source voltage Vgs of the driving TFT DT becomes the threshold voltage Vth of the driving TFT DT, the source voltage VN2 of the driving TFT DT follows a gate voltage VN1 of the driving TFT DT.

The source voltage VN2 of the driving TFT DT charged by the second node N2 is stored in the sensing capacitor Cx formed on the sensing line 15, as the sensing voltage Vsen, via the second switch TFT ST2. When the first switch SW1 inside the data driving circuit 12 is turned off, and at the same time, the second switch SW2 is turned on, the sensing voltage Vsen is detected in a period, in which the mobility sensing gate pulse GPb is maintained at the on-level Lon, and is supplied to the ADC.

The source following manner has an advantage when used with the simple configuration of the pixel because the first and second switch TFTs ST1 and ST2 may be commonly connected to one gate line 16. However, because the gate-source voltage Vgs of the driving TFT DT is continuously reduced during sensing of the mobility the compensation capability of the mobility μ is reduced.

In an embodiment, a width PW2 of the mobility sensing gate pulse GPb is set to be less than a width PW1 of a threshold voltage sensing gate pulse GPa, so as to minimize a reduction in the compensation capability of the mobility μ. Further, a mobility sensing period can be set, so that sensing of the mobility μ is performed in a period, in which the gate-source voltage Vgs of the driving TFT DT is greater than the threshold voltage Vth of the driving TFT DT. As a result, after a first time passed from a start time point (t=0) of the on-level Lon during the threshold voltage sensing gate pulse GPa, sensing of the threshold voltage Vth is performed. On the other hand, sensing of the mobility μ is performed after a second time much shorter than the first time passed from a start time point (t=0) of the on-level Lon of the mobility sensing gate pulse GPb. For example, when one frame period is 8.3 ms, the second time may be, for example, about 100 μs.

In other words, a measurement of the mobility μ is performed during a shorter period than a measurement of the threshold voltage Vth. An embodiment of the invention can be characterized in that the sensing voltage Vsen for the compensation of the mobility μ s detected in a predetermined period, which starts from a generation time point of the on-level Lon of the mobility sensing gate pulse GPb to a time point corresponding to 2% of one frame period.

As shown in FIG. 6, the mobility sensing period may belong to at least one of vertical blank periods VB in an image display period X0, a first non-display period X1 can be arranged prior to the image display period X0, and a second non-display period X2 can be arranged after the image display period X0. The vertical blank periods VB are defined as periods between adjacent display frames DF. The first non-display period X1 may be defined as a period of several tens to several hundreds of frames having passed from an application time point of a driving power enable signal PEN. The second non-display period X2 may be defined as a period of several tens to several hundreds of frames having passed from an application time point of a driving power disable signal PDIS.

A threshold voltage sensing period may be included in the first non-display period X1, the vertical blank periods VB, and the second non-display period X2. Because a relatively long time is required to sense the threshold voltage Vth, it is preferable that the threshold voltages Vth of the driving TFTs of all of the pixels be measured in the first non-display period X1 and/or the second non-display period X2. Further, it is advantageous for the compensation capability to sense the mobility μ for a relatively short amount time. Therefore, it is preferable that the mobilities μ of the predetermined number of pixels are sensed in each vertical blank period VB.

Figure 7:
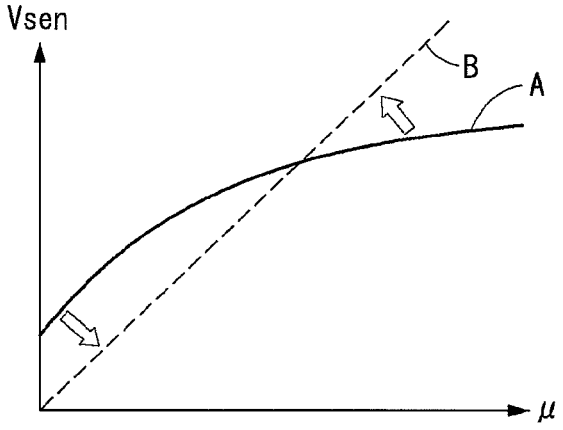
FIGS. 7 and 8 illustrate a method for providing additional improvements to compensation capability and a result thereof according to an embodiment of the invention.
Figure 8:
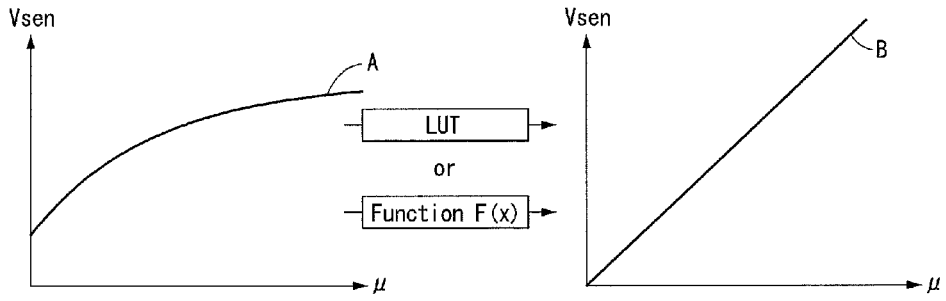

FIGS. 7 and 8 illustrate a method for improving the additional compensation capability and a result thereof.

More specifically, FIGS. 7 and 8 show a graph showing a relationship between the mobility μ and the sensing voltage Vsen. The compensation capability of the mobility t indicates the accuracy of the compensation. As indicated by a graph B of FIGS. 7 and 8, the compensation capability of the mobility μ is best when the mobility μ and the sensing voltage Vsen are directly proportional to each other. The directly proportional relationship indicated by the graph B is obtained when the gate-source voltage Vgs of the driving TFT DT is held constant throughout the sensing period.

Because the embodiment of the invention uses the source following manner for a pixel with a simple circuit structure, the gate-source voltage Vgs of the driving TFT DT continuously varies during the sensing period. Thus, as described above, even if the sensing time of the mobility μ is set to be much shorter than the sensing time of the threshold voltages Vth, the relationship between the mobility μ and the sensing voltage Vsen has a parabola shape as indicated by graph A in FIGS. 7 and 8. As a result, there is somewhat of a limit for increasing the compensation capability.

In an embodiment, the relationship between the mobility μ and the sensing voltage Vsen is corrected from graph A to graph B, so as to further increase the compensation capability of the mobility μ. For this, the timing controller 11 can linearly correct a slope indicating a ratio of a change of the sensing voltage Vsen to a change of the mobility μ and also corrects the sensing voltage Vsen though a lookup table or a compensation function to increase the slope.

The compensation function may be expressed by the following Equation 1.

$$G = \sqrt{\frac{\text{Vsen_ave}}{Vsen + (Vsen - \text{Vsen_ave}) \times K}} \quad \text{[Equation 1]}$$

The timing controller 11 may calculate a gain value G using the above Equation 1, in which the sensing voltage Vsen is received from the data driving circuit 12, and an average sensing voltage Vsen_ave and the physical proportional constant K of the driving TFT are applied. In an embodiment, the average sensing voltage Vsen_ave can correspond to an average of the sensing voltages Vsen extracted from the pixels. The average sensing voltage Vsen_ave may be obtained through a real time calculation and may also be previously set to an initial value that is stored when the display panels are shipped. The physical proportional constant K is determined by a channel capacity including a channel width and a channel length of the driving TFT, the mobility μ of the driving TFT, and a parasitic capacitance between the electrodes of the driving TFT. The timing controller 11 may multiply the input digital video data by the gain value G and may generate the digital compensation data for compensating for the mobility deviation.

Figure 9:
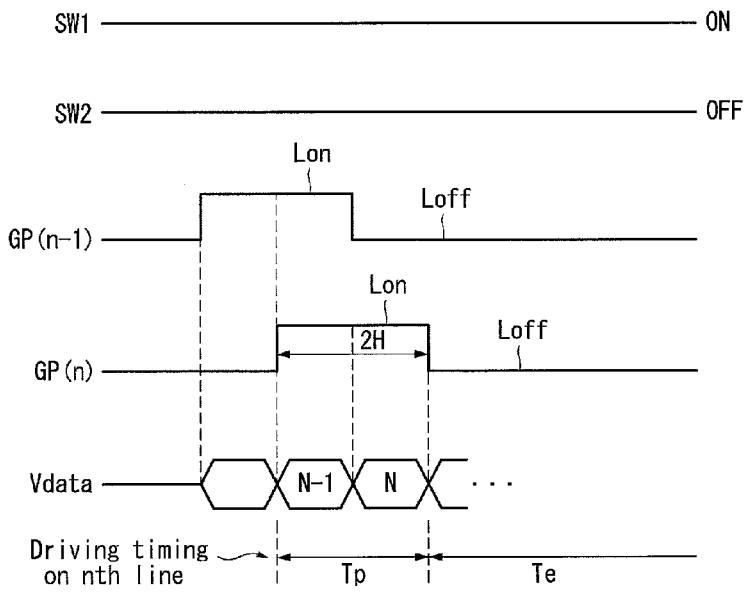
FIG. 9 shows a timing diagram of an image display gate pulse for an image display drive, a data voltage, etc. according to an embodiment of the invention.

FIG. 9 shows a timing diagram of the image display gate pulse for driving the image display, the data voltage, etc.

The image display drive of a predetermined pixel P on an nth line is described below with reference to FIGS. 3 and 9.

The image display drive is divided into a programming period Tp and an emission period Te. Operations performed in the two periods are repeated in each frame period. In the image display drive, the first switch SW1 of the data driving circuit 12 is continuously maintained in a turn-on state, and the second switch SW2 of the data driving circuit 12 is continuously maintained in a turn-off state.

In the programming period Tp, the first and second switch TFTs ST1 and ST2 are simultaneously turned on, in response to an image display gate pulse GPn. Hence, the gate-source voltage Vgs of the driving TFT DT can be programmed at a desired level (e.g., a difference between the Nth data voltage and the initialization voltage Vpre).

In the emission period Te, the first and second switch TFTs ST1 and ST2 are simultaneously turned on, in response to the image display gate pulse GPn, and the driving TFT DT generates the driving current Ioled based on the programmed level of the gate-source voltage Vgs and applies the driving current Ioled to the OLED. The OLED emits light at brightness corresponding to the driving current Ioled and represents gray scale.

The adjacent image display gate pulses GPn and GPn−1 may overlap for a predetermined period in order to secure a sufficient scan period.

As described above, the embodiments of the invention compensate for the deviation between the electrical characteristics of the driving TFTs using the external compensation method and reduces the number of gate lines assigned to each pixel using the source following manner, thereby simplifying the configuration of the gate driving circuit and increasing the aperture ratio of the pixel array. Hence, the image quality of the organic light emitting display can be improved, and the process capability and the mass production can be greatly increased.

Furthermore, according to the embodiments of the invention, the mobility sensing time can be set much shorter than the time for sensing the threshold voltage in the source following manner, thereby increasing the compensation capability of the mobility.

Furthermore, according to the embodiments, the invention can linearly correct a slope indicating a ratio of a change of the sensing voltage to a change of the mobility and also correct the sensing voltage though a lookup table or a compensation function to increase the slope. Hence, the compensation capability of the mobility may be further increased.

Although embodiments of the invention have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel including a plurality of pixels, each pixel using a source following manner, in which a source voltage of a driving thin film transistor (TFT) is changed according to a current flowing between a drain electrode and a source electrode of the driving TFT;

a gate driving circuit configured to generate a mobility sensing gate pulse for operating the pixel in the source following manner;

a data driving circuit configured to detect a sensing voltage corresponding to a mobility of the driving TFT from the pixel in response to the mobility sensing gate pulse; and a timing controller configured to set a mobility sensing period for detecting the sensing voltage in a period, in which a gate-source voltage of the driving TFT is greater than a threshold voltage of the driving TFT, wherein the mobility sensing period is included in a period in which the mobility sensing gate pulse is generated at an on-level, wherein the sensing voltage is detected in a predetermined period, which ranges from a start time point of the on-level of the mobility sensing gate pulse to a time point corresponding to a portion of one frame period, wherein the timing controller linearly corrects a slope indicating a ratio of a change amount of the sensing voltage to a change amount of the mobility and corrects the sensing voltage using a compensation function to increase the slope, wherein the compensation function calculates a gain value G based on a sensing voltage Vsen received from the data driving circuit, an average sensing voltage Vsen_ave, and a physical proportional constant K of the driving TFT, and wherein the timing controller multiplies digital video data by the gain value G, to be input to the pixel, and generates digital compensation data for compensating for a deviation between the mobilities of the driving TFTs.

2. The organic light emitting display of claim 1, wherein each pixel includes:

the driving TFT including a gate electrode connected to a first node, the source electrode connected to a second node, and the drain electrode connected to an input terminal of a high potential driving voltage;

an organic light emitting diode (OLED) connected between the second node and an input terminal of a low potential driving voltage;

a storage capacitor connected between the first node and the second node;

a first switch TFT connected between a data line charged to a threshold voltage compensation data voltage and the first node; and a second switch TFT connected between a sensing line charged to the sensing voltage and the second node, wherein the first and second switch TFTs are simultaneously turned on in response to the mobility sensing gate pulse.

3. The organic light emitting display of claim 1, wherein the mobility sensing period belongs to at least one of a plurality of vertical blank periods during an image display period, a first non-display period arranged prior to the image display period, and a second non-display period arranged after the image display period.

4. The organic light emitting display of claim 1, wherein the compensation function is expressed by the following Equation:

$$G = \sqrt{\frac{\text{Vsen_ave}}{Vsen + (Vsen - \text{Vsen_ave}) \times K}},$$

wherein the timing controller calculates the gain value G using the Equation, in which the sensing voltage Vsen is received from the data driving circuit and the average sensing voltage Vsen_ave and the physical proportional constant K of the driving TFT are applied to the Equation.

5. The organic light emitting display of claim 1, wherein the portion of one frame period corresponds to 2% of one frame period.

6. A method of compensating for mobility of an organic light emitting display including a display panel including a plurality of pixels of a source following manner, in which a source voltage of a driving thin film transistor (TFT) is changed according to a current flowing between a drain electrode and a source electrode of the driving TFT, the method comprising:

generating a mobility sensing gate pulse for operating a pixel in the source following manner;

detecting a sensing voltage corresponding to mobility of the driving TFT from the pixel in response to the mobility sensing gate pulse;

setting a mobility sensing period for detecting the sensing voltage in a period, in which a gate-source voltage of the driving TFT is greater than a threshold voltage of the driving TFT, wherein the mobility sensing period is included in a period in which the mobility sensing gate pulse is generated at an on-level, and wherein the sensing voltage is detected in a predetermined period, which ranges from a start time point of the on-level of the mobility sensing gate pulse to a time point corresponding to a portion of one frame period;

linearly correcting a slope indicating a ratio of a change amount of the sensing voltage to a change amount of the mobility and correcting the sensing voltage using a compensation function to increase the slope; and calculating a gain value G based on a sensing voltage Vsen, an average sensing voltage Vsen_ave, and a physical proportional constant K of the driving TFT, multiplying digital video data by the gain value G, to be input to the pixel, and generating digital compensation data for compensating for a deviation between the mobilities of the driving TFTs.

7. The method of claim 6, wherein the mobility sensing period belongs to at least one of a plurality of vertical blank periods during an image display period, a first non-display period arranged prior to the image display period, and a second non-display period arranged after the image display period.

8. The method of claim 6, wherein the compensation function is expressed by the following Equation:

$$G = \sqrt{\frac{\text{Vsen_ave}}{Vsen + (Vsen - \text{Vsen_ave}) \times K}},$$

wherein the method further comprises calculating the gain value G using the Equation, in which the sensing voltage Vsen, the average sensing voltage Vsen_ave, and the physical proportional constant K of the driving TFT are applied to the Equation.

9. The method of claim 6, wherein the portion of one frame period corresponds to 2% of one frame period.

10. An organic light emitting display comprising:

a display panel including a plurality of pixels, each pixel using a source following manner, in which a source voltage of a driving thin film transistor (TFT) is changed according to a current flowing between a drain electrode and a source electrode of the driving TFT;

a gate driving circuit configured to generate a mobility sensing gate pulse for operating the pixel in the source following manner;

a data driving circuit configured to detect a sensing voltage corresponding to a mobility of the driving TFT from the pixel in response to the mobility sensing gate pulse; and a timing controller configured to set a mobility sensing period for detecting the sensing voltage in a period, in which a gate-source voltage of the driving TFT is greater than a threshold voltage of the driving TFT, wherein each pixel includes:

the driving TFT including a gate electrode connected to a first node, the source electrode connected to a second node, and the drain electrode connected to an input terminal of a high potential driving voltage;

an organic light emitting diode (OLED) connected between the second node and an input terminal of a low potential driving voltage;

a storage capacitor connected between the first node and the second node;

a first switch TFT connected between a data line charged to a threshold voltage compensation data voltage and the first node; and a second switch TFT connected between a sensing line charged to the sensing voltage and the second node, wherein the first and second switch TFTs are both connected to a same gate line and simultaneously turned on in response to the mobility sensing gate pulse, wherein the mobility sensing period is included in a period in which the mobility sensing gate pulse is generated at an on-level, wherein the sensing voltage is detected in a predetermined period, which ranges from a start time point of the on-level of the mobility sensing gate pulse to a time point corresponding to a portion of one frame period, and wherein the data driving circuit includes a third switch and a fourth switch, the third switch turns on a current flow between an input terminal of an initialization voltage and the sensing line, and the fourth switch turns on a current flow between the sensing line and an analog-to-digital converter.

11. The organic light emitting display of claim 10, further comprising:

a sensing capacitor connected to the sensing line, wherein the second switch turns on a current flow between the second node and the sensing line in response to the gate pulse and stores a source voltage of the second node in the sensing capacitor.

12. The organic light emitting display of claim 10, wherein the gate pulse includes a threshold voltage sensing gate pulse, a mobility sensing gate pulse, and an image display gate pulse, each of the threshold voltage sensing gate pulse, the mobility sensing gate pulse, and the image display gate pulse has a different width.

* * * * *